US008206159B2

(12) United States Patent
Naito et al.

(10) Patent No.: US 8,206,159 B2
(45) Date of Patent: Jun. 26, 2012

(54) CONNECTOR THAT ENABLES CONNECTION BETWEEN CIRCUIT BOARDS WITH EXCELLENT SPACE EFFICIENCY

(75) Inventors: Takeharu Naito, Tokyo (JP); Takaaki Kudo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/931,646

(22) Filed: Feb. 7, 2011

(65) Prior Publication Data

US 2011/0256740 A1 Oct. 20, 2011

(30) Foreign Application Priority Data

Apr. 15, 2010 (JP) ..... 2010-093720

(51) Int. Cl.
*H01R 12/00* (2006.01)

(52) U.S. Cl. ..... 439/65

(58) Field of Classification Search ..... 439/65, 439/74, 79, 83, 607.01
See application file for complete search history.

(56) References Cited

U.S. PATENT DOCUMENTS

| | | | | |
|---|---|---|---|---|
| 4,932,888 | A * | 6/1990 | Senor | 439/108 |
| 5,127,839 | A * | 7/1992 | Korsunsky et al. | 439/79 |
| 5,904,581 | A * | 5/1999 | Pope et al. | 439/74 |
| 5,919,063 | A * | 7/1999 | Wang | 439/607.01 |
| 5,944,536 | A * | 8/1999 | Seong et al. | 439/79 |
| 6,093,035 | A * | 7/2000 | Lemke et al. | 439/83 |
| 7,303,401 | B2 * | 12/2007 | Schell et al. | 439/65 |
| 7,314,377 | B2 * | 1/2008 | Northey et al. | 439/79 |
| 7,901,218 | B2 * | 3/2011 | Sato et al. | 439/74 |
| 2011/0039423 | A1 * | 2/2011 | Blasick et al. | 439/65 |
| 2011/0159710 | A1 * | 6/2011 | Crighton et al. | 439/65 |

FOREIGN PATENT DOCUMENTS

JP 08-078107 3/1996

* cited by examiner

*Primary Examiner* — Jean F Duverne
(74) *Attorney, Agent, or Firm* — Collard & Roe, P.C.

(57) ABSTRACT

A particular connector is for selectively connecting a first and a second mating connector which are insertable into the particular connector from mutually perpendicular directions, respectively. The particular connector includes a contact and a housing holding the contacts. The contact has a first a second contact portion which are for contacting with the first and the second mating connectors, respectively. The housing includes a first fitting portion provided with a first insertion opening for inserting the first mating connector, a second fitting portion provided with a second insertion opening for inserting the second mating connector, and guide portions which define the first and the second insertion openings, respectively. By the guide portions, the first and the second mating connectors are allowed to be selectively connected to the connector.

5 Claims, 11 Drawing Sheets

CONNECTOR THAT ENABLES CONNECTION BETWEEN CIRCUIT BOARDS WITH EXCELLENT SPACE EFFICIENCY

This application is based upon and claims the benefit of priority from Japanese patent application No. 2010-093720, filed on Apr. 15, 2010, the disclosure of which is incorporated herein in its entirely by reference.

TECHNICAL FIELD

This invention relates to a connector that allows connection counterparts to be selectively connected thereto from two directions and to a mating connector as one of the connection counterparts and further relates to a board provided with those connectors.

BACKGROUND ART

JP-A-H8-78107 (Patent Document 1) discloses a printed board connector comprising a male connector and a female connector, wherein the male connector is used as both the horizontal mounting type and the vertical mounting type. The printed board connector is configured such that the female connector as a connection counterpart can be connected to the male connector from two directions.

Referring to FIG. 1, the technique disclosed in Patent Document 1 will be briefly explained. The printed board connector comprises a male connector 200 adapted to be mounted on a printed board 100 and a female connector 300 adapted to be fitted to the male connector 200 in the state where connection cables 170 are connected thereto. The male connector 200 is provided with a horizontal-fitting opening 600 and a vertical-fitting opening 700 in its side surface and upper surface, respectively, so that the female connector 300 can be fitted to the male connector 200 from either of a horizontal direction X and a vertical direction Y.

SUMMARY OF THE INVENTION

However, since the printed board connector disclosed in Patent Document 1 is configured such that the female connector of the same structure is connected to the male connector from the horizontal direction or the vertical direction, a relatively large space is required for the connection and thus it is difficult to apply the disclosed printed board connector to the case where the space is limited. Further, since the connection cables are connected to the female connector, when connecting between two boards, the connection structure has a sequence of a male connector, a female connector, connection cables, a female connector, and a male connector so that the number of components increases, resulting in an increase in cost. In addition, particularly when the boards are placed on the same plane and the female connectors are connected to the male connectors in the direction along the plane, it is difficult to place the boards close to each other due to the female connectors being in the way. On the other hand, if the female connectors are connected to the male connectors in the vertical direction, i.e. the direction perpendicular to the boards, there is required a large space with the male connector and the female connector stacked on each board and thus it is difficult to apply this vertical arrangement to the case where the space is limited. Further, in either of the cases, there is a problem that many kinds of components are required.

It is therefore an object of this invention to provide a connector that enables connection between circuit boards with excellent space efficiency.

It is another object of this invention to provide a connector-attached board that can be coupled to another connector-attached board with excellent space efficiency, wherein the number and kinds of components are small and few.

Other object of the present invention will become clear as the description proceeds.

According to an exemplary aspect of the present invention, there is provided a particular connector for selectively connecting a first mating connector and a second mating connector which are insertable into the particular connector from mutually perpendicular directions, respectively, wherein the particular connector comprises a contact and a housing holding the contact, wherein the contact comprises a first contact portion for contacting with the first mating connector and a second contact portion for contacting with the second mating connector, wherein the housing comprises a first fitting portion provided with a first insertion opening for inserting the first mating connector, a second fitting portion provided with a second insertion opening for inserting the second mating connector, and guide portions defining the first insertion opening and the second insertion opening, respectively, and wherein the first mating connector and the second mating connector are allowed to be selectively connected to the connector by the guide portions.

According to another exemplary aspect of the present invention, there is provided a first mating connector comprising a plurality of mating contacts each having a mating contact portion which is adapted to be connected to a first contact portion of a particular connector as a connection counterpart, and a mating housing which holds the mating contacts, wherein, in the plurality of mating contacts, at least one pair of the adjacent mating contacts is such that the mating contacts forming the pair respectively have short-circuit portions which are formed so as to face each other, wherein the short-circuit portions are in contact with each other to connect between the adjacent mating contacts, and wherein, when the first mating connector is connected to the particular connector as the connection counterpart, the short-circuit portions are elastically deformed due to a short-circuit release portion of the particular connector to release connection between the adjacent mating contacts.

According to a still another exemplary aspect of the present invention, there is provided an attached board comprising a circuit board, a first connector, and a second connector, wherein the first connector comprises a first contact and a first housing holding the first contact, wherein the first housing comprises a first and a second insertion opening which are oriented in mutually different directions, and a short-circuit release portion which corresponds to the first insertion opening, wherein the first contact comprises a first contact portion and a second contact portion which correspond to the first insertion opening and the second insertion opening, respectively, wherein the second connector comprises a plurality of second contacts and a second housing holding the second contacts, wherein adjacent two of the second contacts respectively have short-circuit portions being in contact with each other, wherein the first insertion opening has a structure suitable for inserting the second connector, wherein the second insertion opening has a structure suitable for inserting a third connector which differs in shape from the second connector, wherein the first connector and the second connector are configured such that, when the second connector is inserted into the first insertion opening, the short-circuit release portion is inserted between the short-circuit portions to release a short circuit between the adjacent two second contacts, and wherein the first connector and the second connector are mounted at mutually different ends of the circuit board.

DESCRIPTION OF THE EMBODIMENT

Referring first to FIGS. 2 to 5B, a connector-attached board 1 according to an embodiment of this invention will be described.

Figure 1:
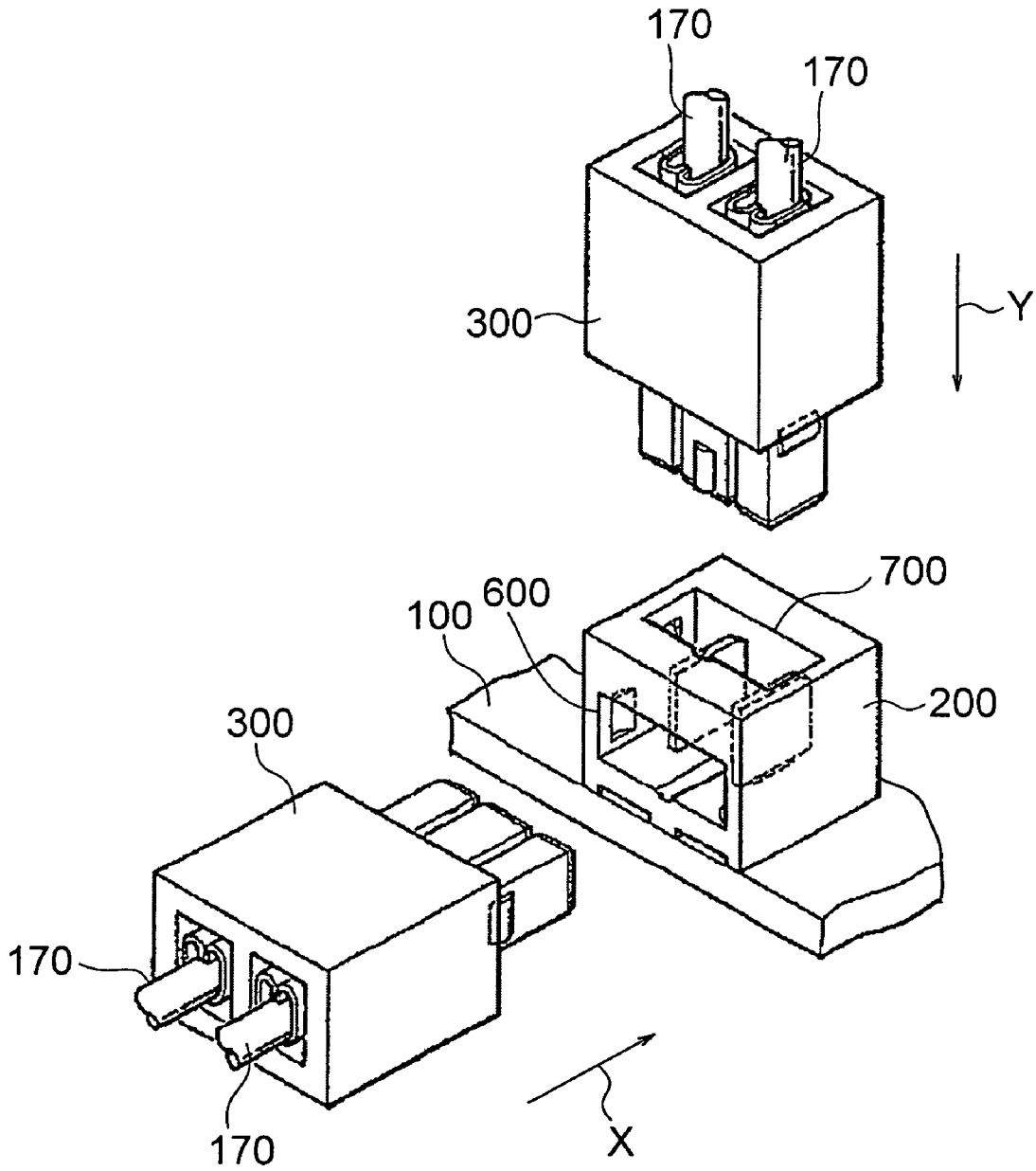
FIG. 1 is a perspective view for explaining the technique disclosed in Patent Document 1 (JP-A-H8-78107)
Figure 2:
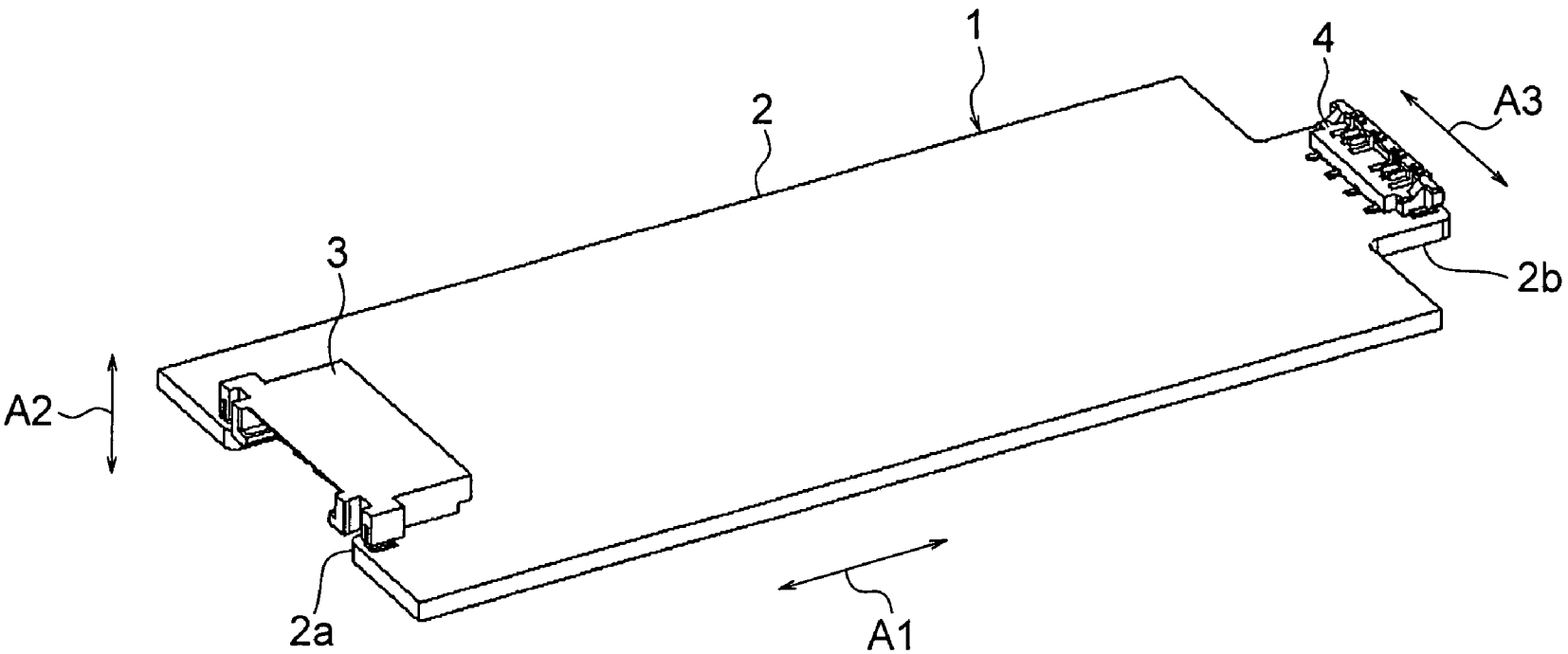
FIG. 2 is a perspective view of a connector-attached board according to an embodiment of this invention.

The connector-attached board 1 shown in FIG. 2 comprises a generally rectangular circuit board 2 having a length of 30 to 40 cm. The circuit board 2 is formed at its both ends in a first direction A1 (a longitudinal direction of the circuit board 2) with a concave portion 2*a* and a convex portion 2*b* which corresponds in shape with the concave portion 2*a*. A first connector 3 and a second connector 4 are mounted on an upper surface of the circuit board 2 so as to correspond to the concave portion 2*a* and the convex portion 2*b*, respectively. That is, the first connector 3 and the second connector 4 are provided at both ends, in the first direction A1, of the circuit board 2, respectively.

A large number of light-emitting elements (not illustrated) such as LEDs are further mounted on the upper surface of the circuit board 2 between the first connector 3 and the second connector 4. The light-emitting elements are connected to each other to form four parallel lines (not illustrated) each extending in the first direction A1 between the first connector 3 and the second connector 4. The four lines form two pairs of the lines and the two lines forming each pair are shorted to each other by the second connector 4. As will become clear later, the first connector 3 and the second connector 4 have structures that allow them to be fitted to and removed from each other before they are mounted on the circuit board 2. Specifically, the first connector 3 can serve as a plug while the second connector 4 can serve as a receptacle.

Figure 3:
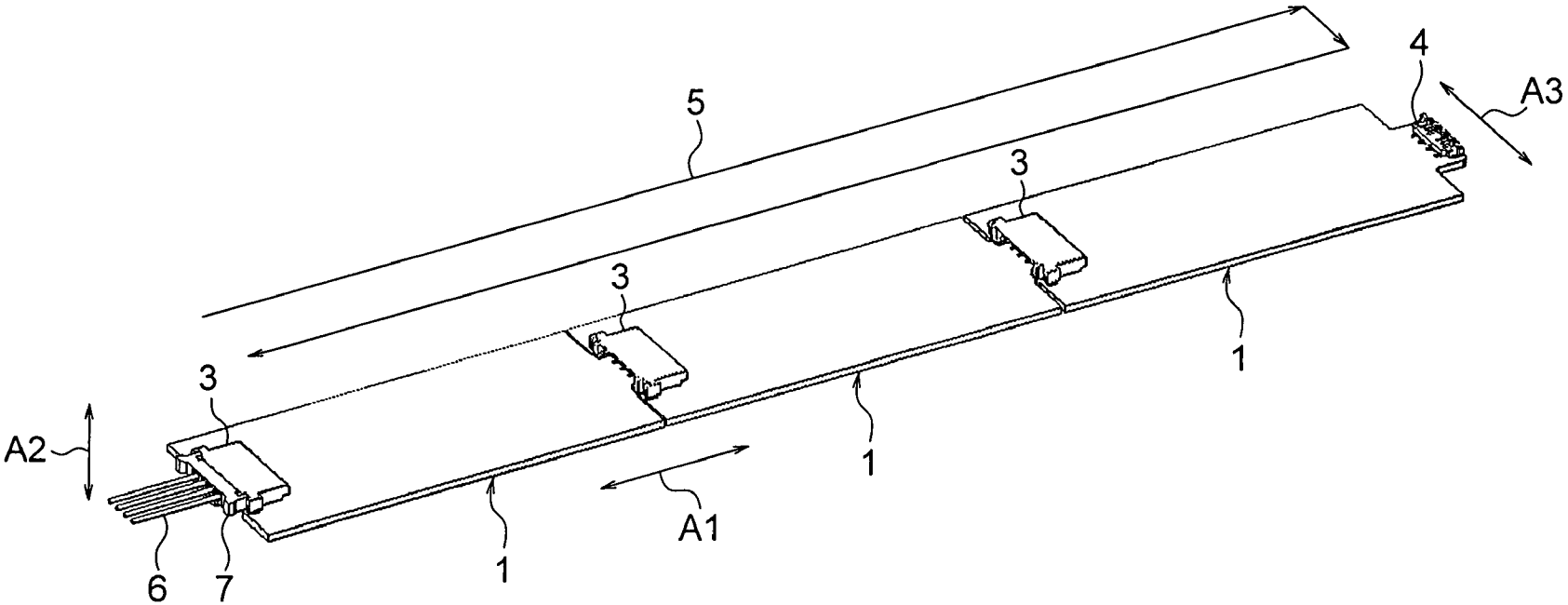
FIG. 3 is a perspective view showing a state where three connector-attached boards, each being the same as the connector-attached board of FIG. 2, are coupled to each other.
Figure 4A:
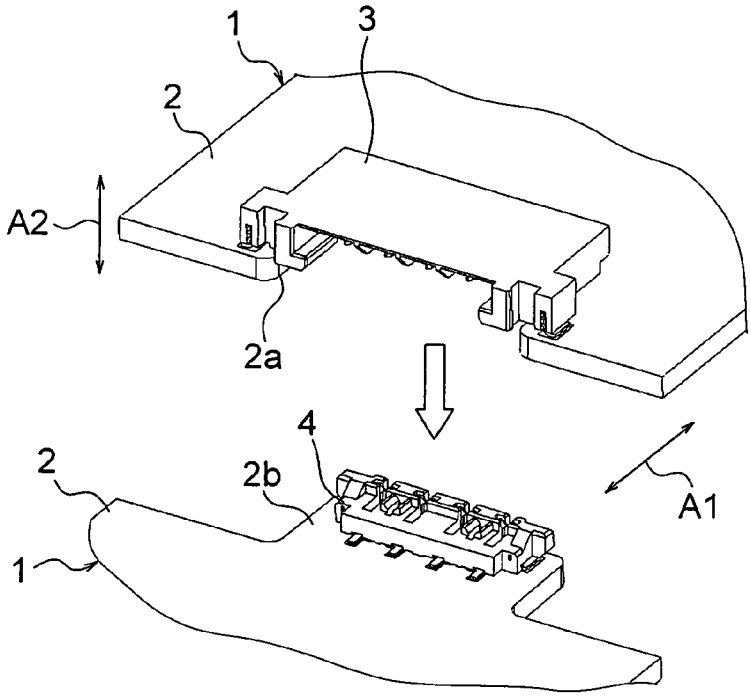
FIG. 4A is a perspective view for explaining a method of coupling the connector-attached boards to each other.
Figure 4B:
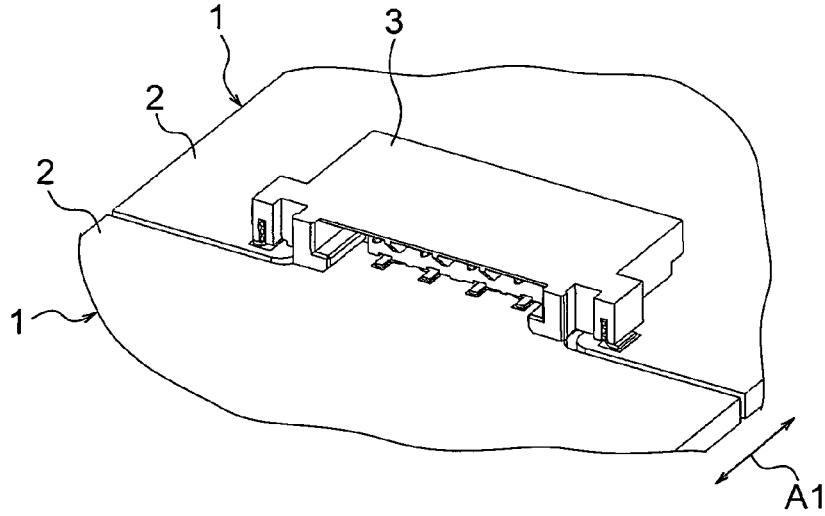
FIG. 4B is a perspective view showing a state where connectors of the connector-attached boards are coupled to each other.

As shown in FIG. 3, a plurality of connector-attached boards 1, each being the same as the connector-attached board 1 of FIG. 2, are prepared and placed on the same plane in the state where they are adjacent to each other in the first direction A1. In this event, while fitting the concave portion 2*a* of the circuit board 2 to the convex portion 2*b* of the adjacent circuit board 2, the first connector 3 is fitted to the second connector 4. The fitting of the concave portion 2*a* to the convex portion 2*b* and the fitting of the first connector 3 to the second connector 4 are both carried out in a second direction A2 (a thickness direction of the circuit board 2) perpendicular to the first direction A1. Specifically, the concave portion 2*a* is first located above the convex portion 2*b* as shown in FIG. 4A and then is lowered and fitted to the convex portion 2*b* as indicated by an outline arrow so that the first connector 3 is fitted to the second connector 4. In this manner, the adjacent connector-attached boards 1 are coupled to each other as shown in FIG. 4B.

When the first connector 3 is fitted to the second connector 4, the lines of the adjacent circuit boards 2 are connected to each other through the first connector 3 and the second connector 4. Simultaneously, as will be described in detail later, the first connector 3 releases the short circuits between the lines which are caused by the second connector 4 as described above. As a result, there are formed four parallel lines each extending in the first direction A1 over the adjacent connector-attached boards 1. In this case, the second connector 4 serves as a first mating connector being one of connection counterparts of the first connector 3.

In the state shown in FIG. 3, the second connector 4 at one end with no first connector 3 fitted thereto shorts the two lines, in each pair, of the four lines and thus, actually, a pair of two-way lines, each as exemplarily shown at numeral 5 in the figure, are formed throughout all the connector-attached boards 1 so as to be spaced apart from and parallel to each other in a third direction A3 perpendicular to the first and second directions A1 and A2. Both ends of each two-way line are connected to the first connector 3 located at the other end. Therefore, only by connecting a third connector 7, being a harness connector with cables 6 connected thereto, to this first connector 3 located at the other end, it is easily possible to supply the power to the two-way lines 5 to drive the large number of light-emitting elements. In order to efficiently use the light emission of the light-emitting elements, the first connector 3 is preferably configured to completely cover the second connector 4 and to at least have a white surface, thereby preventing absorption of the light emitted from the light-emitting elements as much as possible.

Figure 5A:
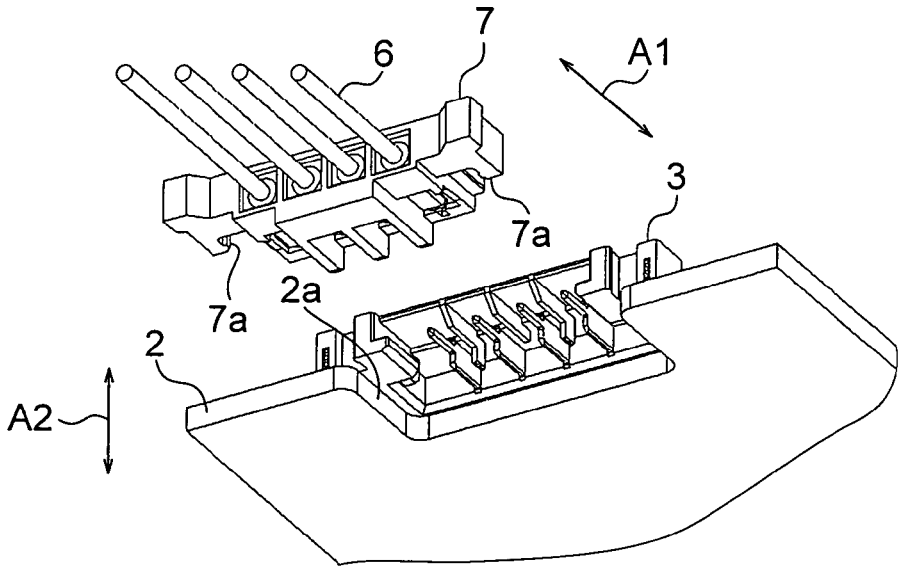
FIG. 5A is a perspective view for explaining a method of connecting cables to the connector-attached board.
Figure 5B:
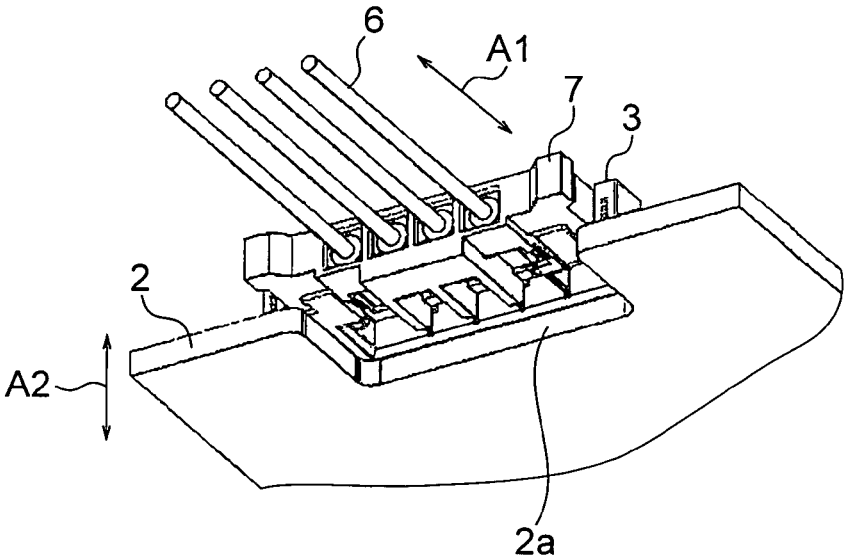
FIG. 5B is a perspective view showing a state where a connector of the connector-attached board and a connector with the cables connected thereto are connected to each other.

For connecting the third connector 7 to the first connector 3, the third connector 7 is first located to face the first connector 3 in the first direction A1 as shown in FIG. 5A. Then, the third connector 7 is moved toward the first connector 3, thereby fitting the third connector 7 to the first connector 3 as shown in FIG. 5B. In this case, the third connector 7 serves as a second mating connector being the other of the connection counterparts of the first connector 3. The third connector 7 differs in shape from the second connector 4.

Figure 6A:
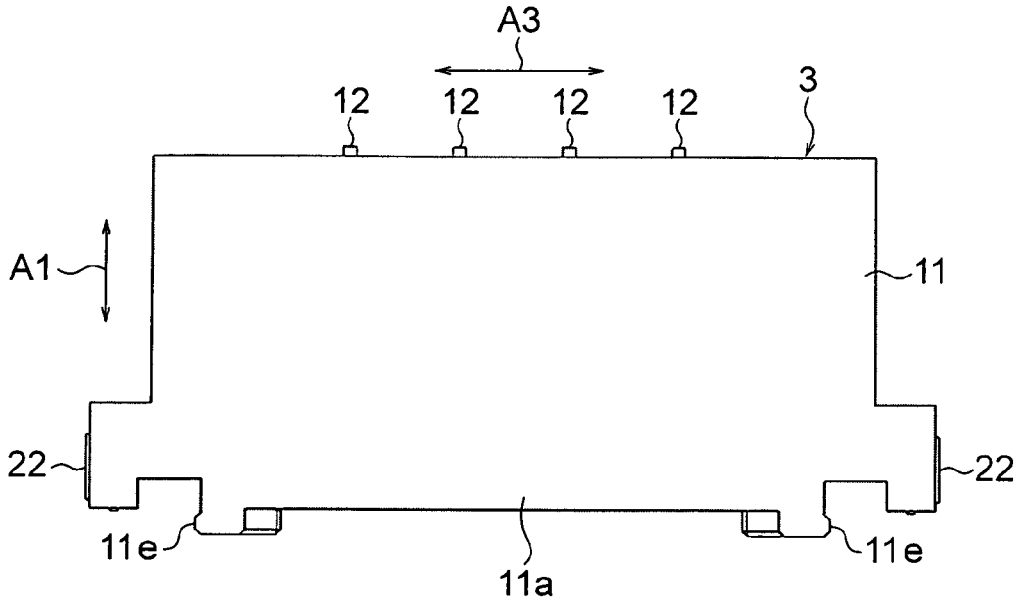
FIG. 6A is a plan view of a first connector which is mounted on the connector-attached board of FIG. 2.
Figure 6B:
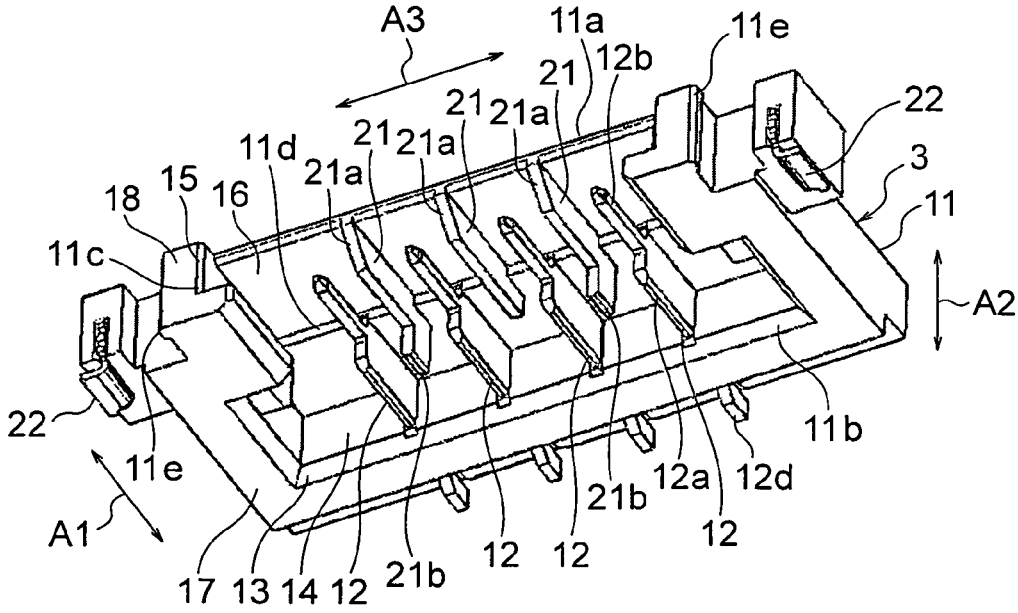
FIG. 6B is a perspective view, as seen from below, of the first connector.
Figure 7:
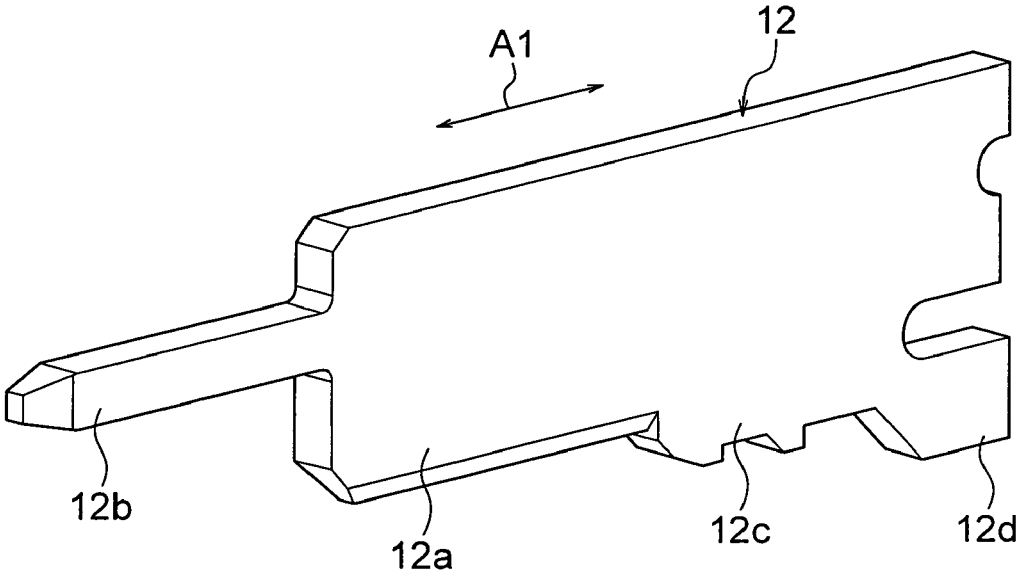
FIG. 7 is a perspective view of a first contact included in the first connector.

Referring to FIGS. 6A to 7 in addition to FIGS. 2 and 3, the first connector 3 will be described assuming that it is mounted on the circuit board 2.

As shown in FIGS. 6A and 6B, the first connector 3 comprises a first insulating housing 11 and a plurality of, for example, four, first conductive contacts 12 held by the first housing 11.

The first housing 11 has a first fitting portion 14 provided with a first insertion opening 13 for inserting the second connector 4, a second fitting portion 16 provided with a second insertion opening 15 for inserting the third connector 7, and guide portions 17 and 18 defining the first insertion opening 13 and the second insertion opening 15, respectively. The first insertion opening 13 is opened to face the concave portion 2*a* of the circuit board 2 in the second direction A2 and has a structure suitable for inserting the second connector 4. The second insertion opening 15 is opened at substantially the same position as that of an end face of the circuit board 2 so as to be oriented in the first direction A1 and has a structure suitable for inserting the third connector 7. Naturally, the first housing 11 may be provided with a wall portion that clearly defines the first insertion opening 13 and the second insertion opening 15.

The first contacts 12 are arranged at regular intervals in the third direction A3. As shown in FIG. 7, each of the first contacts 12 has a first plate-like contact portion 12*a* for contact with the second connector 4 and a second rectangular-prism contact portion 12*b* for contact with the third connector 7. That is, the first contact portion 12*a* and the second contact portion 12*b* differ in shape from each other. The first contact 12 further has a holding portion 12*c* and a terminal portion 12*d*. From FIG. 7, it is clear that the first contact 12 has a plate-like shape as a whole.

As seen from FIG. 6B, the first contact portion 12*a* is disposed in the first fitting portion 14 of the first housing 11 so as to correspond to the first insertion opening 13, while the second contact portion 12*b* is disposed in the second fitting portion 16 of the first housing 11 so as to correspond to the second insertion opening 15. The holding portion 12*c* is fixedly held by the first housing 11 by press fitting or the like. The terminal portion 12*d* is connected by soldering or the like to the corresponding one of the above-mentioned four lines formed on the circuit board 2. The first housing 11 is formed with holes each for inserting the first contact 12 therethrough. It is preferable that each hole be chamfered or tapered for facilitating the insertion of the first contact 12.

The first housing 11 further has a plurality of, for example, three, insulating plate-like ribs 21 which are formed integral with a lower surface of a top wall 11*a* and are located between the first contacts 12, respectively. The two, at both ends, of these ribs 21 each have an erroneous-insertion preventing portion 21*a* extending to the second insertion opening 15 in the first direction A1 for preventing erroneous insertion of the third connector 7 and a short-circuit release portion 21*b* extending toward the first insertion opening 13 in the second direction A2. The middle rib 21 has only an erroneous-insertion preventing portion 21*a* extending to the second insertion opening 15 in the first direction A1 for preventing erroneous insertion of the third connector 7. The function of the short-circuit release portion 21*b* will be made clear later.

At both ends in the third direction A3, the first housing 11 is provided with metal holddowns 22, respectively, which are fixed to the circuit board 2 by soldering or the like. The metal holddowns 22 are disposed so as to be substantially flush with the terminal portions 12*d* of the first contacts 12. Further, the first insertion opening 13 is provided with a taper 11*b* for facilitating the insertion of the second connector 4 while the second insertion opening 15 is provided with a taper 11*c* for facilitating the insertion of the third connector 7.

The top wall 11*a* of the first housing 11 is formed at its lower surface with a butting portion lid which faces the second insertion opening 15 for allowing the inserted third connector 7 to butt against it. Further, locking portions 11*e* are respectively formed near both ends, in the third direction A3, of the first housing 11. The locking portions 11*e* serve to maintain the third connector 7 in a connected state by engaging, in the first direction A1, with to-be-locked portions 7*a* of the third connector 7 shown in FIG. 5A, respectively.

By the structures of the guide portions 17 and 18, the first connector 3 allows the second connector 4 and the third connector 7, which are adapted to be inserted thereinto from mutually perpendicular directions, to be selectively connected thereto.

Figure 8A:
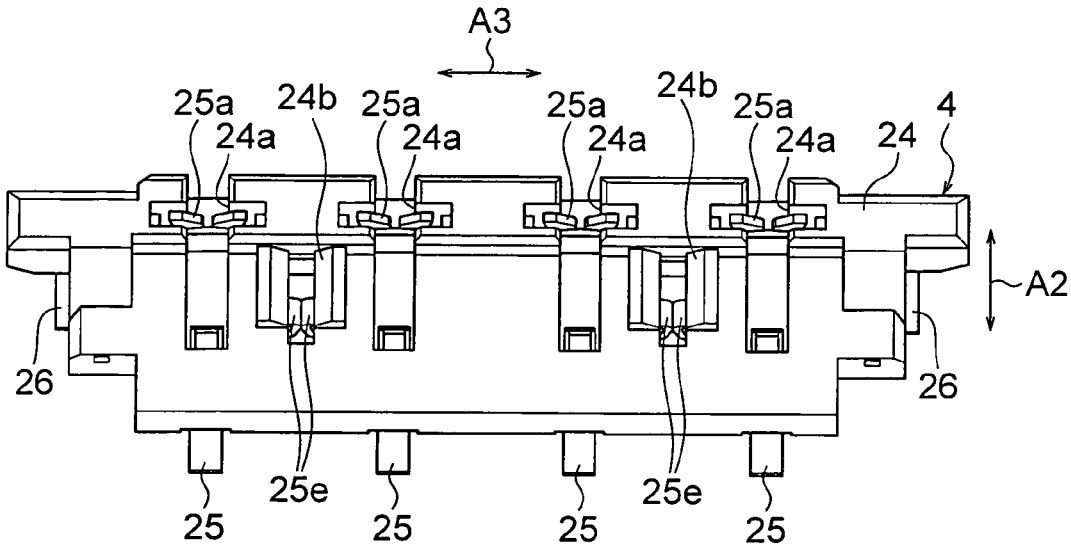
FIG. 8A is a plan view of a second connector which is mounted on the connector-attached board of FIG. 2.
Figure 8B:
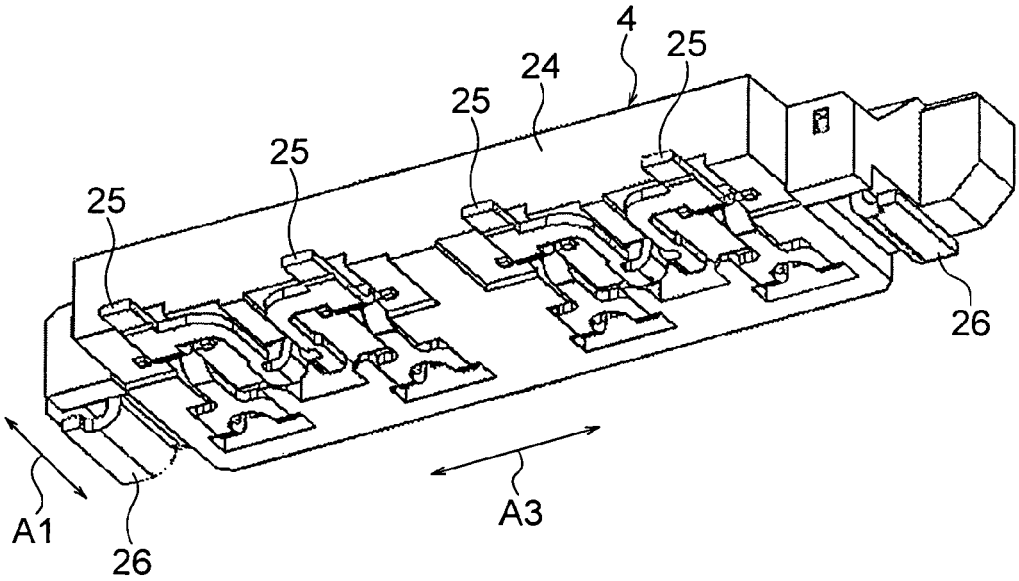
FIG. 8B is a perspective view, as seen from below, of the second connector.
Figure 8C:
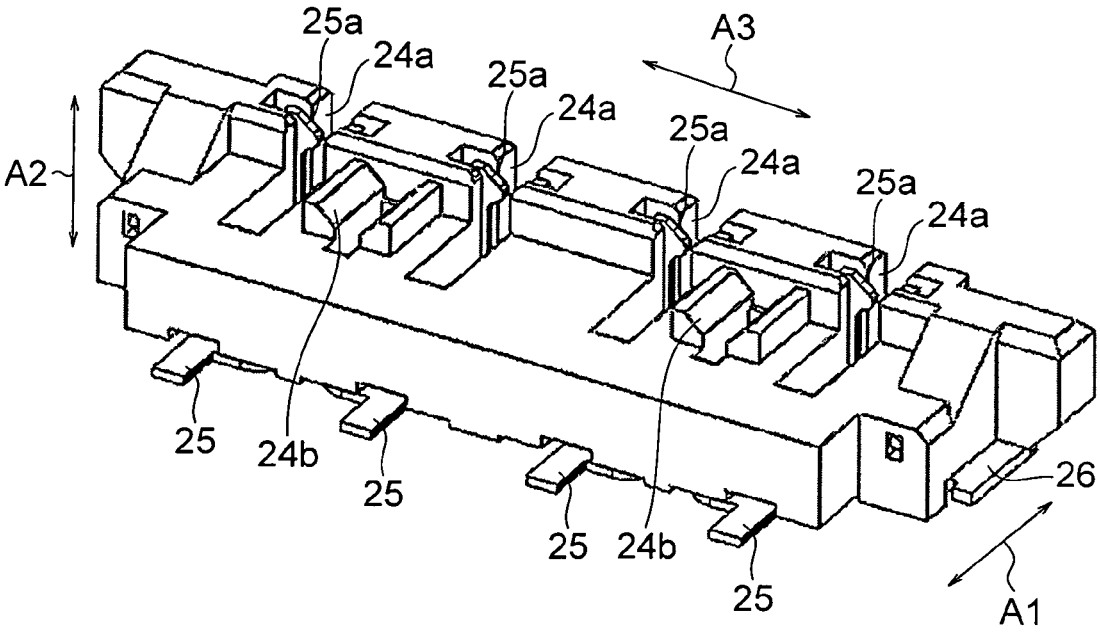
FIG. 8C is a perspective view, as seen from above, of the second connector.
Figure 8D:
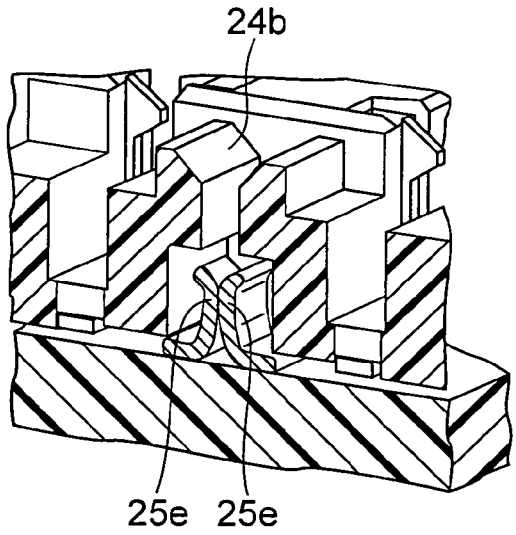
FIG. 8D is a cross-sectional perspective view showing part of the second connector.
Figure 9:
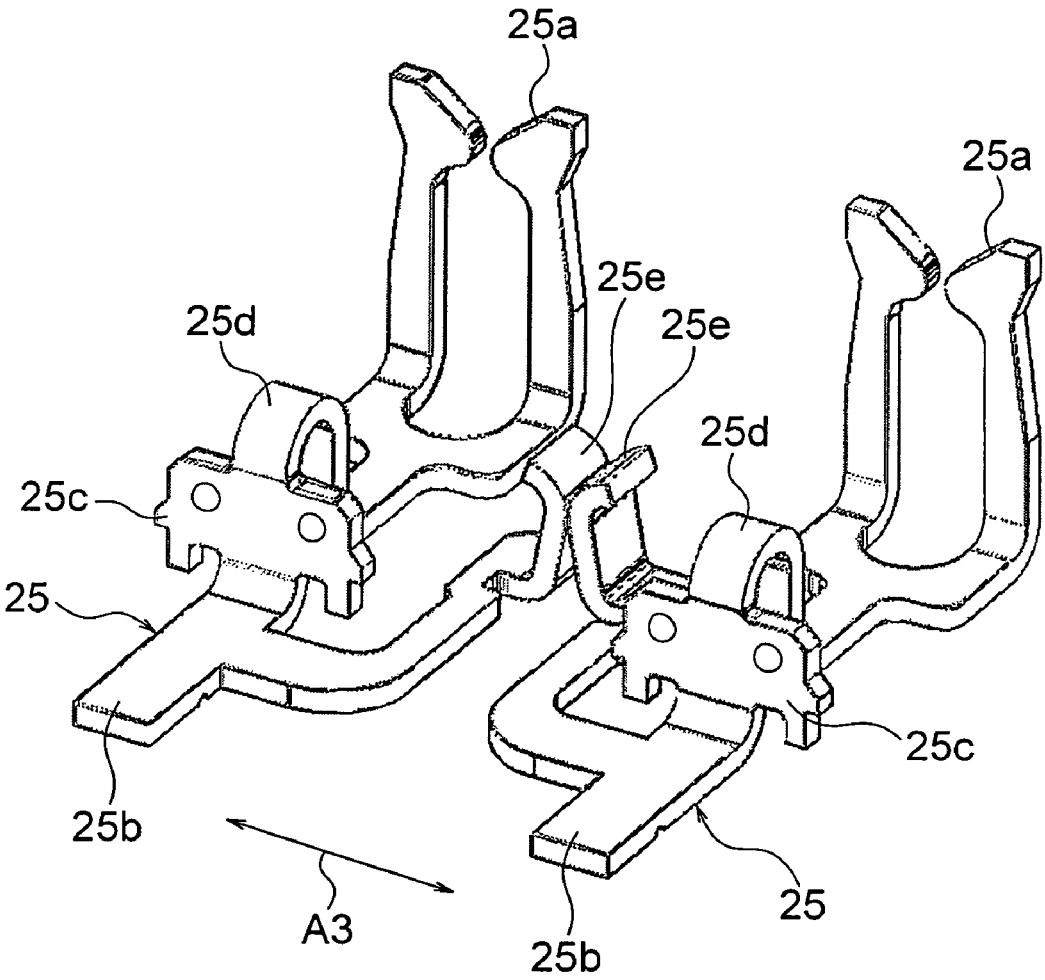
FIG. 9 is a perspective view showing two second contacts included in the second connector in the state where the two second contacts are adjacent to each other.

Referring further to FIGS. 8A to 9, the second connector 4 will be described assuming that it is mounted on the circuit board 2.

The second connector 4 serves as the first mating connector and comprises a second insulating housing 24 and a plurality of, for example, four, mating conductive contacts or second conductive contacts 25 held by the second housing 24.

As shown in FIG. 9, each of the second contacts 25 has a bifurcated contact portion (mating contact portion) 25*a* for contact with the first plate-like contact portion 12*a* of the first contact 12, a terminal portion 25*b* connected by soldering or the like to the corresponding one of the above-mentioned four lines, a holding portion 25*c* located between the contact portion 25*a* and the terminal portion 25*b* and held by the second housing 24, an elasticity applying portion 25*d* formed between the contact portion 25*a* and the holding portion 25*c*, and a short-circuit portion 25*e* extending from between the terminal portion 25*b* and the holding portion 25*c*.

As shown in FIGS. 8A to 8C, the second contacts 25 are arranged in the third direction A3. Of the second contacts 25, the two on the left and the two on the right in FIG. 8A form pairs, respectively. As is clear from FIG. 9, the second contacts 25 forming each pair are such that the short-circuit portions 25*e* are formed on mutually opposite sides in the third direction A3 and are in contact with each other. Therefore, the four lines formed on each of the circuit boards 2 before coupling to each other are such that the two lines forming each pair are shorted to each other through the corresponding pair of the second contacts 25.

As shown in FIGS. 8A to 8C, the second housing 24 has groove-like contact guide portions 24*a* and through short-circuit release guide portions 24*b*. Positions of the contact guide portions 24*a* and the short-circuit release guide portions 24*b* are determined so that when the first connector 3 is fitted to the second connector 4, the first contact portions 12*a* of the first contacts 12 are guided by the contact guide portions 24*a*, respectively, and the short-circuit release portions 21*b* of the ribs 21 are guided by the short-circuit release guide portions 24*b*, respectively. The contact portion 25*a* of the second contact 25 is disposed corresponding to each contact guide portion 24*a* and, as shown in FIG. 8D, the short-circuit portions 25*e* of the pair of the second contacts 25 are disposed corresponding to each short-circuit release guide portion 24*b*. At both ends in the third direction A3, the second housing 24 is provided with holddowns 26, respectively, which are substantially flush with the terminal portions 25*b* of the second contacts 25.

Referring to FIGS. 6B, 8C, 10A, and 10B, a description will be given of the case where the first connector 3 mounted on one circuit board 2 is fitted to the second connector 4 mounted on another circuit board 2.

When the second connector 4 is inserted into the first insertion opening 13 of the first connector 3, the first contact portions 12*a* of the first contacts 12 are guided by the contact guide portions 24*a* so as to be inserted thereinto while being in contact with the bifurcated contact portions 25*a*, respectively. Therefore, the four lines of the adjacent two circuit boards 2 are connected in series with each other, respectively.

Figure 10A:
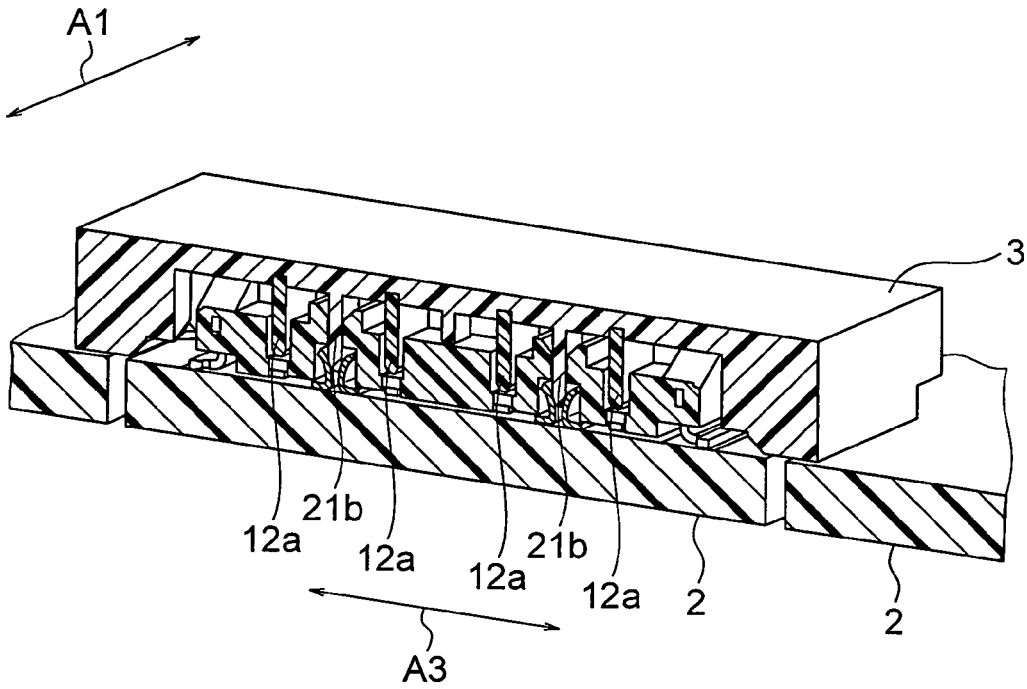
FIG. 10A is a cross-sectional perspective view showing a state where the connectors of the connector-attached boards are coupled to each other.
Figure 10B:
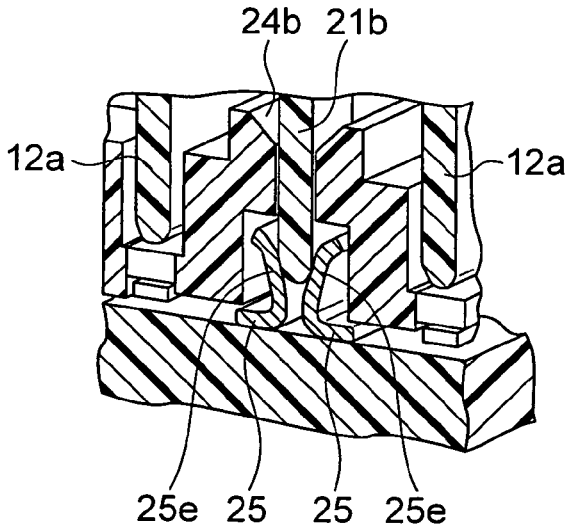
FIG. 10B is an enlarged view showing a main part of FIG. 10A.

Simultaneously, the short-circuit release portions 21*b* are guided by the short-circuit release guide portions 24*b*, respectively, so that each short-circuit release portion 21*b* is forcibly inserted between the two short-circuit portions 25*e* being in contact with each other. Then, as shown in FIGS. 10A and 10B, the short-circuit portions 25*e* are displaced with elastic deformation due to the short-circuit release portion 21*b* so as to be spaced apart from each other. Therefore, the short circuit between the lines caused by each pair of the second contacts 25 is released. As a result, a pair of two-way lines, each as exemplarily shown at numeral 5 in FIG. 3, can be easily formed throughout all the connector-attached boards 1 so as to be spaced apart from and parallel to each other in the third direction A3.

In this case, since the second contacts 25 forming each pair are shorted to each other in advance in the second connector 4 with no first connector 3 fitted thereto, it is not necessary to use a special short-circuit member. Further, since the circuit boards 2 can be connected to each other on one plane by the fitting between the first and second connectors 3 and 4, a space required for the connection can be small and it is possible to achieve cost reduction by reducing the number of components. Further, the kinds of connectors can be few.

The above-mentioned connector, first mating connector, and connector-attached board are each suitable for use in a liquid crystal display device that uses LEDs for backlighting.

This invention is not limited to the above-mentioned embodiment and part or the whole thereof can also be described as the following supplementary notes but is not limited thereto.

(Supplementary Note 1)

A particular connector 3 for selectively connecting a first mating connector 4 and a second mating connector 7 which are insertable into the particular connector from mutually perpendicular directions, respectively, wherein the particular connector comprises:

a contact 12; and a housing 11 holding the contact, wherein the contact comprises:

a first contact portion 12*a* for contacting with the first mating connector; and a second contact portion 12*b* for contacting with the second mating connector, wherein the housing comprises:

a first fitting portion 14 provided with a first insertion opening 13 for inserting the first mating connector;

a second fitting portion 16 provided with a second insertion opening 15 for inserting the second mating connector; and guide portions 17 and 18 defining the first insertion opening and the second insertion opening, respectively, and wherein the first mating connector and the second mating connector are allowed to be selectively connected to the connector by the guide portions.

The connector of Supplementary note 1 enables connection between circuit boards with excellent space efficiency.

(Supplementary Note 2)

The particular connector according to supplementary note 1, comprising a short-circuit release portion 21*b* that is inserted between adjacent mating contacts of the first mating connector to release a short circuit between short-circuit portions of the mating contacts when the first mating connector is connected to the connector.

(Supplementary Note 3)

The particular connector according to supplementary note 1, wherein the first contact portion and the second contact portion differ in shape from each other.

(Supplementary Note 4)

A first mating connector 4 comprising:

a plurality of mating contacts 25 each having a mating contact portion 25*a* which is adapted to be connected to a first contact portion 12*a* of a particular connector as a connection counterpart; and a mating housing 24 which holds the mating contacts, wherein, in the plurality of mating contacts, at least one pair of the adjacent mating contacts is such that the mating contacts forming the pair respectively have short-circuit portions 25*e* which are formed so as to face each other, wherein the short-circuit portions are in contact with each other to connect between the adjacent mating contacts, and wherein, when the first mating connector is connected to the particular connector as the connection counterpart, the short-circuit portions are elastically deformed due to a short-circuit release portion 21*b* of the particular connector to release connection between the adjacent mating contacts.

The first mating connector of Supplementary note 4 enables connection between circuit boards with excellent space efficiency, wherein the number and kinds of components are small and few.

(Supplementary Note 5)

A connector-attached board 1 comprising:

a circuit board 2;

a first connector 3; and a second connector 4, wherein the first connector comprises:

a first contact 12; and a first housing 11 holding the first contact, wherein the first housing comprises:

a first and a second insertion opening 13 and 14 which are oriented in mutually different directions; and a short-circuit release portion 21*b* which corresponds to the first insertion opening, wherein the first contact comprises a first contact portion 12*a* and a second contact portion 12*b* which correspond to the first insertion opening and the second insertion opening, respectively, wherein the second connector comprises:

a plurality of second contacts 25; and a second housing 24 holding the second contacts, wherein adjacent two of the second contacts respectively have short-circuit portions 25*e* being in contact with each other, wherein the first insertion opening has a structure suitable for inserting the second connector, wherein the second insertion opening has a structure suitable for inserting a third connector which differs in shape from the second connector, wherein the first connector and the second connector are configured such that, when the second connector is inserted into the first insertion opening, the short-circuit release portion is inserted between the short-circuit portions to release a short circuit between the adjacent two second contacts, and wherein the first connector and the second connector are mounted at mutually different ends of the circuit board.

The connector-attached board of Supplementary note 5 can be coupled to another connector-attached board with excellent space efficiency, wherein the number and kinds of components are small and few.

What is claimed is:

1. A particular connector comprising:

a contact; and a housing holding the contact, wherein the contact comprises:

a first contact portion for contacting with a first mating connector; and a second contact portion for contacting with a second mating connector which is different from the first mating connector in appearance thereof, wherein the housing comprises:

a first fitting portion provided with a first insertion opening for inserting the first mating connector, the first insertion opening being directed to a specific direction;

a second fitting portion connected to the first fitting portion and provided with a second insertion opening for inserting the second mating connector, the second insertion opening being directed to a particular direction perpendicular to the specific direction;

a first guide portion connected to the first fitting portion for defining the first insertion opening to fit the first mating connector; and a second guide portion connected to the second fitting portion for defining the second insertion opening to fit the second mating connector.

2. The particular connector according to claim 1, comprising a short-circuit release portion that is inserted between adjacent mating contacts of the first mating connector to release a short circuit between short-circuit portions of the mating contacts when the first mating connector is connected to the connector.

3. The particular connector according to claim 1, wherein the first contact portion and the second contact portion differ in shape from each other.

4. A first mating connector comprising:

a plurality of mating contacts each having a mating contact portion which is adapted to be connected to a first contact portion of a particular connector as a connection counterpart; and a mating housing which holds the mating contacts, wherein, in the plurality of mating contacts, at least one pair of the adjacent mating contacts is such that the mating contacts forming the pair respectively have short-circuit portions which are formed so as to face each other, wherein the short-circuit portions are in contact with each other to connect between the adjacent mating contacts, and wherein, when the first mating connector is connected to the particular connector as the connection counterpart, the short-circuit portions are elastically deformed due to a short-circuit release portion of the particular connector to release connection between the adjacent mating contacts.

5. A connector-attached board comprising:

a circuit board;

a first connector; and a second connector, wherein the first connector comprises:

a first contact; and a first housing holding the first contact, wherein the first housing comprises:

a first and a second insertion opening which are oriented in mutually different directions; and a short-circuit release portion which corresponds to the first insertion opening, wherein the first contact comprises a first contact portion and a second contact portion which correspond to the first insertion opening and the second insertion opening, respectively, wherein the second connector comprises:

a plurality of second contacts; and a second housing holding the second contacts, wherein adjacent two of the second contacts respectively have short-circuit portions being in contact with each other, wherein the first insertion opening has a structure suitable for inserting the second connector, wherein the second insertion opening has a structure suitable for inserting a third connector which differs in shape from the second connector, wherein the first connector and the second connector are configured such that, when the second connector is inserted into the first insertion opening, the short-circuit release portion is inserted between the short-circuit portions to release a short circuit between the adjacent two second contacts, and wherein the first connector and the second connector are mounted at mutually different ends of the circuit board.

* * * * *